US012540783B2

(12) United States Patent
Seidl

(10) Patent No.: US 12,540,783 B2
(45) Date of Patent: Feb. 3, 2026

(54) BOLT HEAD OF A BREECH BLOCK AND BREECH BLOCK WITH SUCH A BOLT HEAD

(71) Applicant: Blaser Group GmbH, Isny (DE)

(72) Inventor: Paul Seidl, Argenbühl (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 18/621,200

(22) Filed: Mar. 29, 2024

(65) Prior Publication Data

US 2024/0328734 A1 Oct. 3, 2024

(30) Foreign Application Priority Data

Mar. 30, 2023 (DE) ..... 10 2023 108 227.2

(51) Int. Cl.
*F41A 3/46* (2006.01)

(52) U.S. Cl.
CPC ..... *F41A 3/46* (2013.01)

(58) Field of Classification Search
CPC ..... F41A 15/14; F41A 3/40; F41A 3/46
USPC ..... 42/25, 46
See application file for complete search history.

(56) References Cited

U.S. PATENT DOCUMENTS 1,672,540 A * 6/1928 Page ..... F41A 15/14 42/25
2,590,981 A 4/1952 Lippert
2,756,640 A 7/1956 Maillard
2,831,403 A 4/1958 Maillard
3,253,362 A * 5/1966 Gitchell ..... F41A 19/30 42/16
3,370,372 A * 2/1968 Thompson ..... F41A 3/40 42/16
3,835,566 A 9/1974 Bielfeldt
3,848,351 A * 11/1974 Clark ..... F41F 1/10 42/25
3,906,651 A * 9/1975 Vesamaa ..... F41A 15/14 42/25
4,194,433 A * 3/1980 Zellweger ..... F41A 3/40 89/190
4,240,325 A * 12/1980 Hurlemann ..... F41A 3/40 89/190
8,069,600 B2 * 12/2011 Rousseau ..... F41A 3/26 42/25
8,272,312 B2 9/2012 Kneppler
9,879,929 B2 1/2018 Leimer
(Continued)

FOREIGN PATENT DOCUMENTS

AT 397862 B 7/1994
DE 637801 A 11/1936
(Continued)

OTHER PUBLICATIONS

Result of examination report for German Patent Application No. 10 2023 108 227.2, filed Mar. 30, 2023.
(Continued)

*Primary Examiner* — Bret Hayes
(74) *Attorney, Agent, or Firm* — Fleit Intellectual Property Law; Paul D. Bianco

(57) ABSTRACT

A bolt head of a breech block includes a base element, a breech face arranged on the front of the base element, and a bezel enclosing the breech face in an annular fashion. The bezel is formed by several bezel parts detachably fastened to the base element.

13 Claims, 6 Drawing Sheets

(56) References Cited

U.S. PATENT DOCUMENTS

| | | | | |
|---|---|---|---|---|
| 2015/0128468 | A1* | 5/2015 | Doiron | F41A 15/14 29/434 |
| 2023/0099273 | A1* | 3/2023 | Craig | F41A 15/14 42/25 |

FOREIGN PATENT DOCUMENTS

| | | | |
|---|---|---|---|
| DE | 860019 | | 12/1952 |
| DE | 2227780 | C3 | 8/1981 |
| DE | 20 2004 007661 | U1 | 9/2005 |
| DE | 20 2008 007 768 | U1 | 10/2009 |
| EP | 3096107 | A2 | 11/2016 |

OTHER PUBLICATIONS

Search Report dated Jul. 9, 2024 for European Patent Application No. 24153631.7.

* cited by examiner

BOLT HEAD OF A BREECH BLOCK AND BREECH BLOCK WITH SUCH A BOLT HEAD

FIELD OF THE INVENTION

The invention relates to a bolt head of a breech block. The invention also relates to a breech block with such a bolt head.

BACKGROUND

Breech blocks generally contain a bolt element movable relative to a cartridge chamber and lockable in a closed position by means of a locking device, which contains a bolt head at its front end for sealing off the cartridge chamber to the rear. A breech for a semi-automatic rifle with a locking chamber arranged in a bolt guide is known from DE 20 2008 007 768 U1. At its front end, the locking chamber has a bolt end with a breech face and a bezel that encircles the breech face in annular fashion to enclose the cartridge rim on the cartridge base of the cartridge arranged in the cartridge chamber. The breech face resting against the cartridge base and the bezel enclosing the cartridge rim on the cartridge base at the front end of the bolt head when the breech is closed are intended to prevent propellant gases from escaping to the rear. Ordinarily, the annular bezel laterally delimiting the breech face is made in one part with a base element of the bolt head and the bolt head with a cartridge ejector typically provided there is adapted to a specific caliber and a desired cartridge ejection direction. In rifles with interchangeable barrels, a large number of different bolt heads must therefore be made available for a change in caliber and a change in cartridge ejection direction.

SUMMARY

An object of the invention is to devise a bolt head of a breech block and a breech block with such a bolt head, which enable simple and more cost-effective adjustment to different cartridge ejection directions and a change in caliber.

This object is achieved by a bolt head disclosed herein and a breech block disclosed herein. Further practical developments and advantageous embodiments of the invention are also disclosed herein.

The bolt head according to the invention contains a base element uniformly applicable for different calibers and different ejection directions, to which several bezel parts forming an annular bezel of the breech face are detachably fastened. The bezel parts serving to laterally delimit the breech face can thus be easily arranged at different positions of the base element to adjust the cartridge ejection direction or be replaced by additional bezel parts adapted to the desired caliber during a change in caliber. For a change in caliber or a change in cartridge ejection direction, complete bolt heads need not be furnished. Depending on the caliber and cartridge ejection direction, correspondingly adjusted bolt heads can instead be simply assembled using a standardized base element and easily installed. This can reduce the costs for a change in caliber or adjustment of cartridge ejection direction.

In a particularly advantageous embodiment, the bezel can be formed by two half-ring-shaped bezel parts detachably fastened to the base element to laterally delimit the breech face. However, the bezel can also be formed by more than two interchangeable bezel parts.

In order to detachably releasable hold the bezel parts on the base element, the front of the base element can advantageously include continuous holding groove around the outer periphery for shape-mated engagement of the bezel parts.

In a particularly advantageous embodiment for assembly and reliable holding, the bezel parts can have an inner contact surface at the rear for contact with the breech face, and a hook-like shoulder for engagement in the holding groove. The bezel parts can be held together by a circlip. For reliable holding of the circlip, the bezel parts preferably have an annular groove on the outside for accommodating the circlip. For anti-rotational holding, the circlip advantageously has an inwardly protruding perpendicular end piece at one or both ends for engagement in a radial blind hole on the outside of a bezel part.

To specify a defined position of the bezel parts on the base element that is secured from rotation, appropriate positioning elements can be arranged on the inside of the bezel parts for shape-mated engagement in corresponding mating elements on the outside of the base element.

An inwardly curved guide surface for guiding pivotable locking elements can be arranged on the base element. A claw-like cartridge ejector can also be formed integrally with one of the bezel parts.

The invention also relates to a breech block with a bolt carrier, on which the bolt head just described and a locking device for holding the bolt head in a locking position are arranged.

The locking device advantageously contains two diametrically opposed locking elements pivotable between a locking position and a release position by means of a control element. The locking elements are preferably mounted to pivot around a common transverse axis.

BRIEF DESCRIPTION OF THE DRAWINGS

Additional details and advantages of the invention will become apparent from the following description of a preferred illustrative embodiment with reference to the drawing. In the drawing.

DETAILED DESCRIPTION

Figure 1:
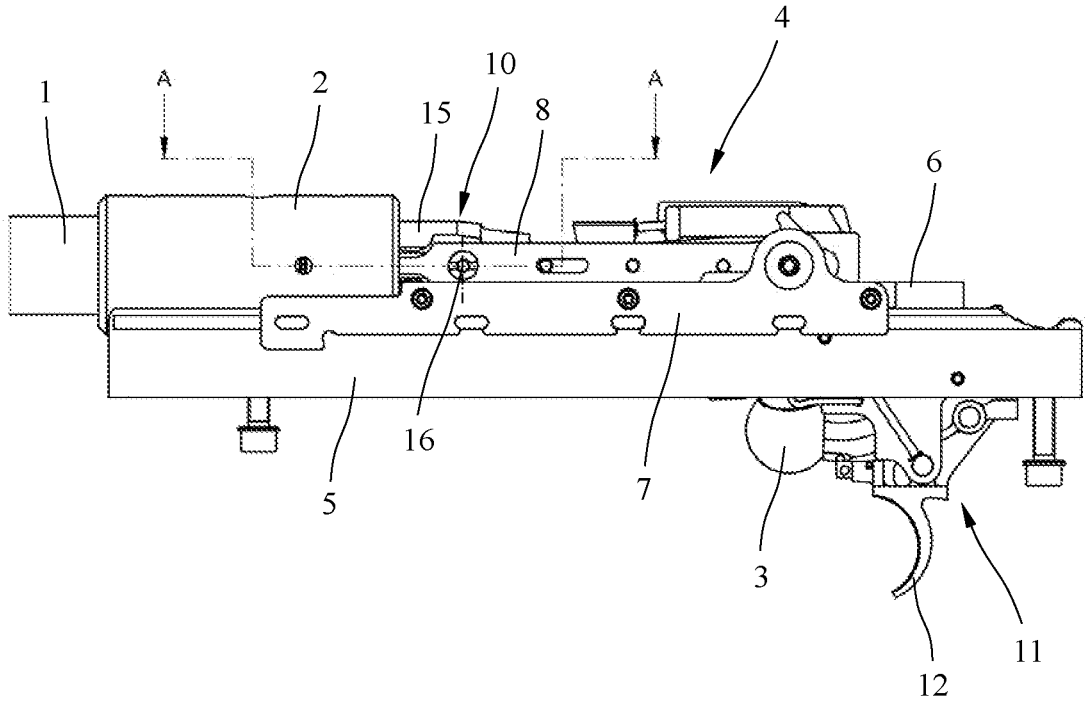
FIG. 1 is a side view of part of a rifle with a barrel, a locking sleeve and a breech block.
Figure 2:
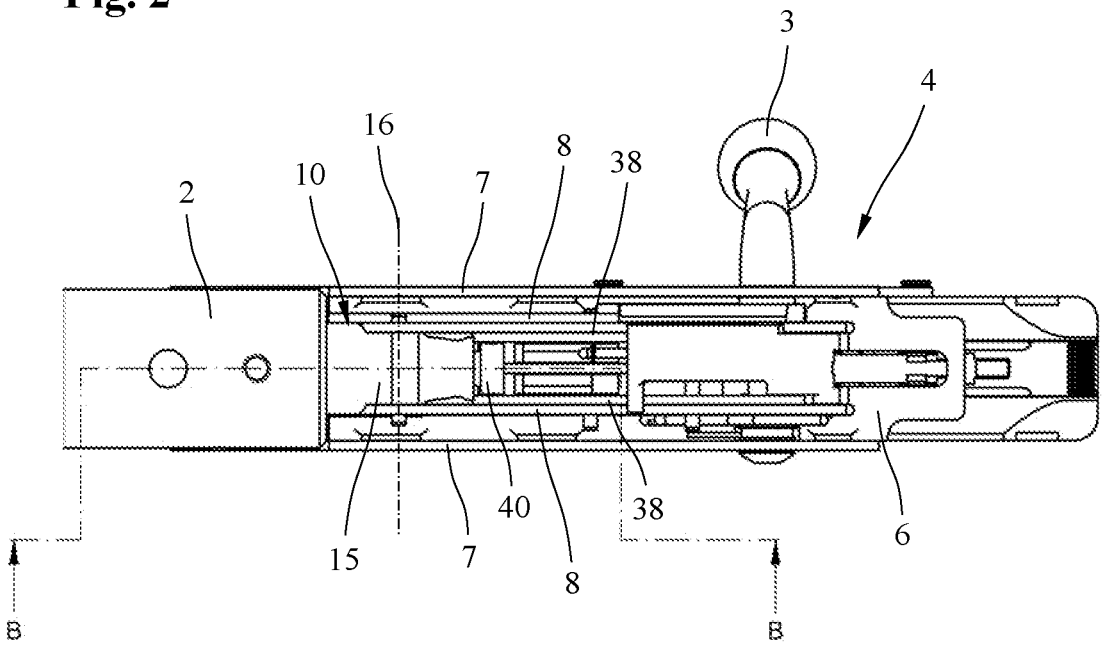
FIG. 2 is a top view of the part of a rifle with breech block shown in FIG. 1.
Figure 3:
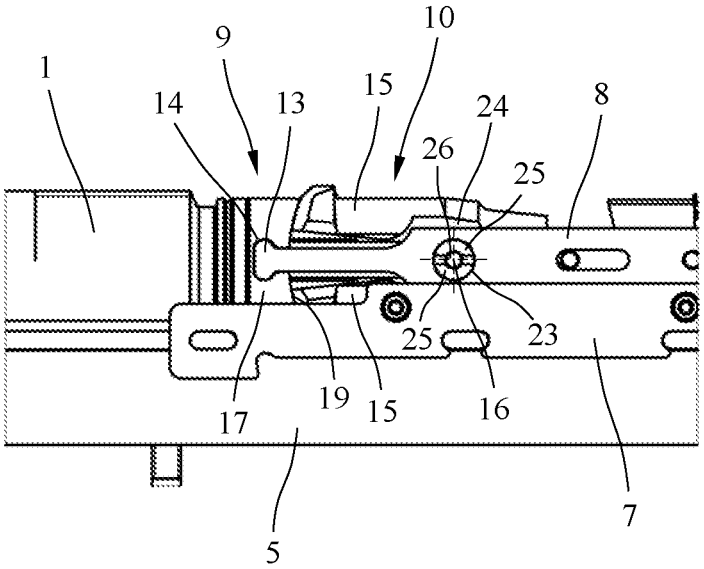
FIG. 3 is a side view of the front part of the breech block shown in FIGS. 1 and 2, with the locking sleeve hidden.

FIGS. 1 and 2 show part of a rifle designed as a straight-pull repeating rifle is shown in with a barrel 1, a locking sleeve 2, and a breech block 4 designed here as a bolt-action chamber and movable relative to the barrel 1 by means of a bolt handle 3, between a rear opening position and a front closure position relative to barrel 1, as seen in a side view and top view. The breech block 4, which is slidably guided to move on a receiver or breech housing 5, contains a bolt carrier 6 with two parallel outer guide rails 7 and two parallel inner plate-like holding elements 8, on which a bolt head 9 shown in FIG. 3 is arranged to seal off a cartridge chamber to the rear, and a locking device 10 is arranged to hold the bolt head 9 in a locking position. A trigger mechanism 11 with a trigger latch 12 visible in FIG. 1 is arranged on the receiver or breech housing 5.

As can be seen in particular from FIG. 3, the bolt head 9 is held by the front ends of the plate-like holding elements 8, which are preferably designed as sheet metal parts. For this purpose, the plate-like holding elements 8 each have a head-like widening 13 at the front ends thereof for shape-mated engagement in correspondingly designed, diametrically opposed recesses 14 on bolt the head 9.

Figure 6A:
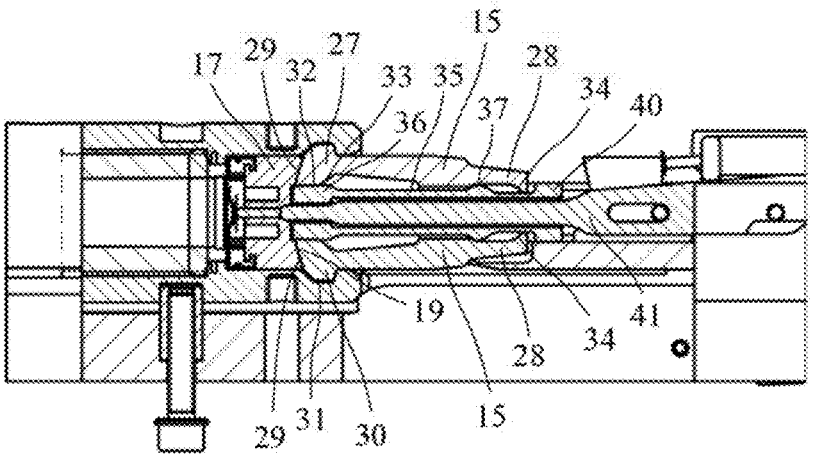
FIG. 6A is a cross-section along line B-B of FIG. 2 with the locking elements in the locking position and FIG. 6B is a cross section along line B-B of FIG. 2 with the locking elements in the release position.

In the illustrative embodiment shown, the locking device 10 consists of two diametrically opposed half-shell shaped upper and lower locking elements 15, which can be pivoted between the two plate-like holding elements 8 around a common transverse axis 16 between an inwardly pivoted release position (FIG. 6B) and an outwardly pivoted locking position (FIG. 6A).

Figure 4:
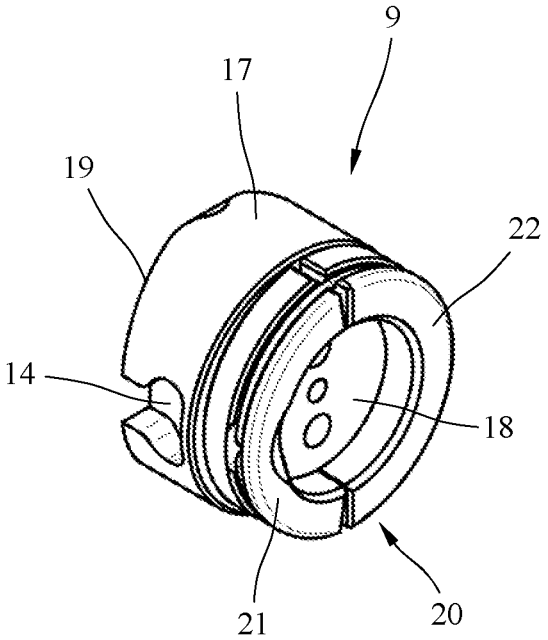
FIG. 4 is a perspective view of a bolt head of the breech block shown in FIGS. 1 and 2.
Figure 5:
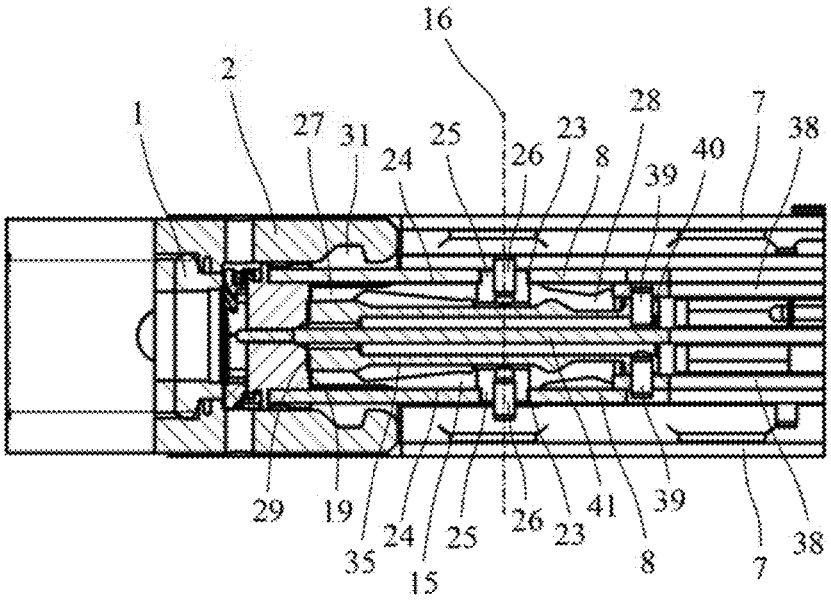
FIG. 5 is a cross-section along line A-A of FIG. 1.

Bolt head 9, shown in a perspective view in FIG. 4, contains an essentially cylindrical base element 17, which, at its front side, contains a breech face 18 perpendicular to a longitudinal axis of the base element 17, and on its back side, an inwardly curved guide surface 19, visible in FIGS. 3 and 5, for guiding the pivotable locking elements 15. The two opposed recesses 14 for shape-mated engagement of the front ends 13 of the two plate-like holding elements 8 are arranged on the outside of the cylindrical base element 17. The bolt head 9 also contains a bezel 20 enclosing the breech face 18 in annular fashion, which, in the embodiment shown, is formed by two half-ring-shaped bezel parts 21 and 22 detachably arranged on the front of the base element 17.

As can be seen from FIGS. 3 and 5, the two diametrically opposed upper and lower half-shell shaped locking elements 15 are mounted to pivot in aligned transverse holes 23 of the two plate-like holding elements 8 around the common transverse axis 16. For this purpose, the two locking elements 15 have two diametrically opposed flats 24 on their outside with outwardly protruding half-ring-shaped journals 25. The upper locking element 15 rests with its two diametrically opposed journals 25 against the upper inside wall of the two aligned transverse holes 23, whereas the lower locking element 15 with its two diametrically opposed journals 25 rests against the lower inside wall of the two aligned transverse holes 23. The locking elements 15 are held pivotably on the two plate-like holding elements 8 via the pins 26 inserted between the journals 25.

Figure 6B:
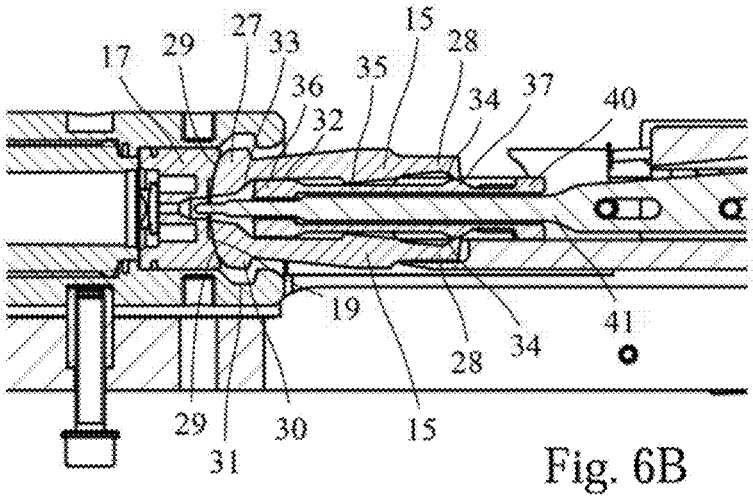
Figure 7:
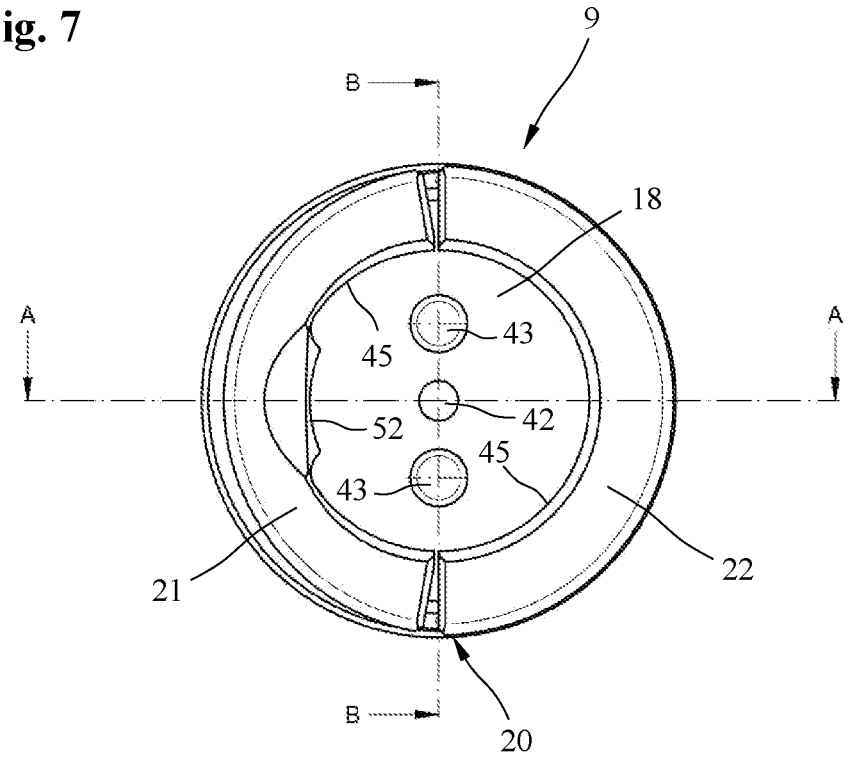
FIG. 7 is a front view of the bolt head shown in FIG. 4.
Figure 8:
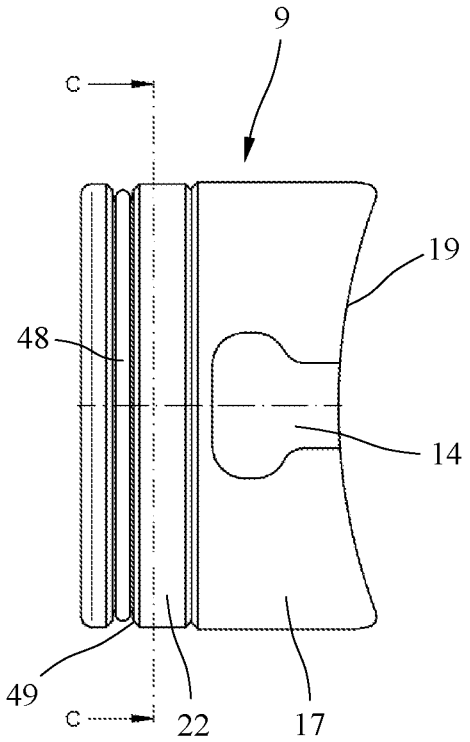
FIG. 8 is a side view of the bolt head shown in FIG. 4.
Figure 9:
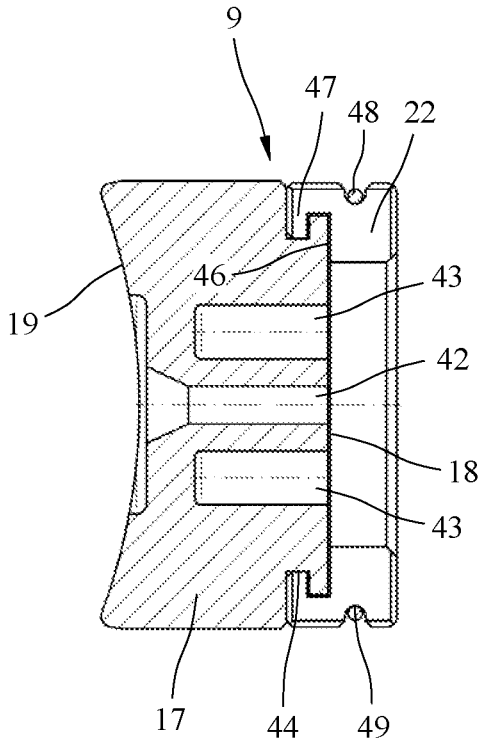
FIG. 9 is a cross-section along line B-B of FIG. 7.

It can be seen in FIGS. 5 and 6A and 6B that the half-shell shaped locking elements 15 have a front part 27 protruding forward relative to the journals 25 and a rear part 28 extending rearward relative to journals 25. An outwardly curved contact surface 29 is provided on the front side of their front part 27 protruding forward relative to the journals 25. for contact with the rear guide surface 19 on the back of the bolt head 9. The front contact surfaces 29 of the locking elements 15 are matched to the rear guide surface 19 of the bolt head 9 so that the locking elements 15 are guided on the rear guide surface 19 of the bolt head 9 when moved between the release position and the locking position.

Half-ring- or partial-ring-shaped locking shoulders 30 are provided on the outside of the front part 27 of the locking elements 15 for engagement in an inner annular groove 31 at the rear end of the locking sleeve 2, as can be seen in FIG. 5. In the locking position of the locking elements 15, the locking shoulders 30 engage in shape-mated fashion in the annular groove 31, whereas in the release position of the locking elements 15, the locking shoulders 30 are pivoted inwardly so that the breech block 4 can be pulled rearward for opening. An inner, slightly conical support surface 32 and an oblique front control surface 33 are provided on the inside of the front part 27 of the locking elements 15 for moving the locking elements 15 into the locking position, as shown in FIG. 6A. An oblique rear control surface 34, which protrudes rearward relative to the journal 25, is arranged on the inside of the rear part 28 of the locking elements 15 for moving the locking elements 15 into the release position, as shown in FIG. 6B.

A sleeve-like control element 35 coupled to the bolt handle 3 for axial displacement is arranged between the two half-shell shaped locking elements 15 to control the movement of the locking elements 15 between the locking position and the release position. At its front end, the sleeve-like control element 35 has a front support area 36 designed as a radial widening for moving the locking elements 15 into the locking position and a rearward offset ramp-like rear support area 37 for moving the locking elements 15 into the release position. By axial displacement of the sleeve-like control element 35 relative to the two locking elements 15, the locking elements 15 can thus not only be moved into the locking position, but also forced back into the release position without additional springs or other separate restoring elements. This reduces the expense for parts and improves reliability.

For axial displacement of the sleeve-like control element 35, the same is coupled to the bolt handle 3 via two parallel plate-like push parts 38 also shown in FIG. 2 so that the control element 35 can be moved between a front locking position and a rear unlocking position by rotation of bolt handle 3. For this purpose, the two plate-like push parts 38 are connected at their front ends to a cylindrical rear end 40 of the control element 35 via pins 39, as shown in FIG. 5. If the control element 35 is pushed forward from a rear unlocking position, the locking shoulders 30 on the front part 27 of the two locking elements 15 are forced radially outward via the front support area 36 and the oblique front control surfaces 33 and held in the locking position by the conical support surface 32. When the control element 35 is pulled back into the rear unlocking position, the locking elements 15 are pivoted by contact of the rear support area 37 against the oblique rear control surfaces 34 of locking elements 15 so that the locking shoulders 30 on the front part 27 of the two locking elements 15 are forced radially inward into a release position. Consequently, a particularly stable and functionally reliable breech block with secure locking and unlocking is achieved with relatively few and inexpensively produced parts. A firing pin 41 is guided to move axially within the sleeve-like control element 35.

FIGS. 7 to 11 show a perspective view of the bolt head 9 of FIG. 4 with the essentially cylindrical base element 17 in different views. As already explained above, the base element 17 has, on its front side, a breech face 18 perpendicular to a longitudinal axis of the base element 17 and, on its back side, an inwardly curved guide surface 19 for guiding the pivotable locking elements 15. A central through-opening 42 is arranged in base element 17 for guiding a front end of the firing pin 41. Two blind holes 43 open to the front are also arranged in base element 17 radially offset relative to the through-opening 42 to accommodate pin-like, spring-loaded cartridge ejectors. The bolt head 9 also contains a bezel 20 enclosing the breech face 18 in annular fashion, which, in the embodiment shown, is formed by two bezel parts 21 and 22 detachably arranged on the front of the base element 17. For this purpose, the base element 17 has a holding groove 44 on the front side thereof, which runs along the peripheral edge, and which can be seen in FIGS. 9 and 10, for shape-mated engagement of the two bezel parts 21 and 22.

Figure 10:
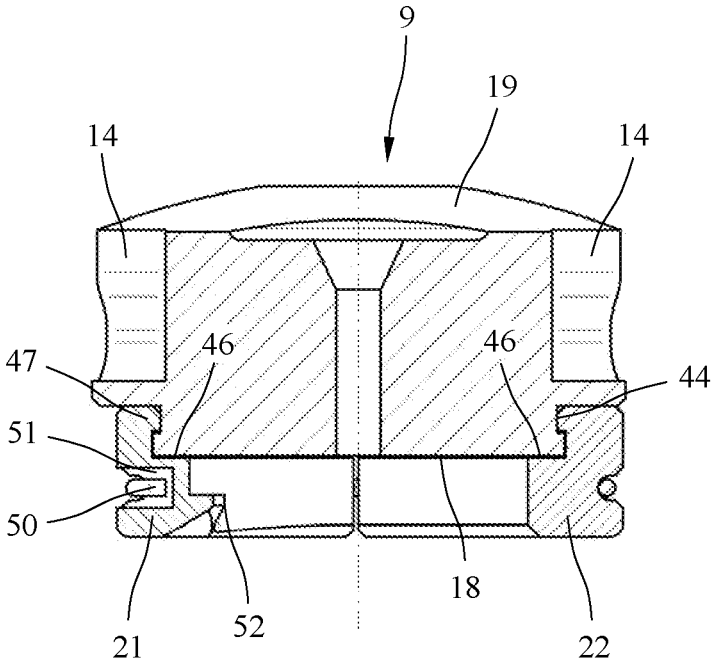
FIG. 10 is a cross-section along line A-A of FIG. 7.

In the embodiment shown, two bezel parts 21 and 22 designed as half-rings are inserted into the holding groove 44 enclosing the outside base element 17. The two half-ring-shaped bezel parts 21 and 22 each have a half-shell shaped inside surface 45 for delimiting an inside diameter adjusted to the caliber. The two half-ring-shaped bezel parts 21 and 22 also contain an inner contact surface 46 on their rear side for contact with the breech face 18, and a hook-like shoulder 47 for shape-mated engagement in the holding groove 44. The two bezel parts 21 and 22 are held together via a circlip 48 and fixed in the holding groove 44. For this purpose, the bezel parts 21 and 22 contain an annular groove 49 on their outside for accommodating the circlip 48 enclosing the two bezel parts 21 and 22. For anti-rotation retention, the circlip 48 has end piece 50 at its two ends, which protrude inwardly at right angles, as shown in FIG. 10, for engagement in a radial blind hole 51 on the outside of bezel part 21. An inwardly protruding claw-shaped cartridge ejector 52 is formed integrally with the left bezel part 21 in FIG. 7 for ejecting the cartridge casing from the chamber.

Figure 11:
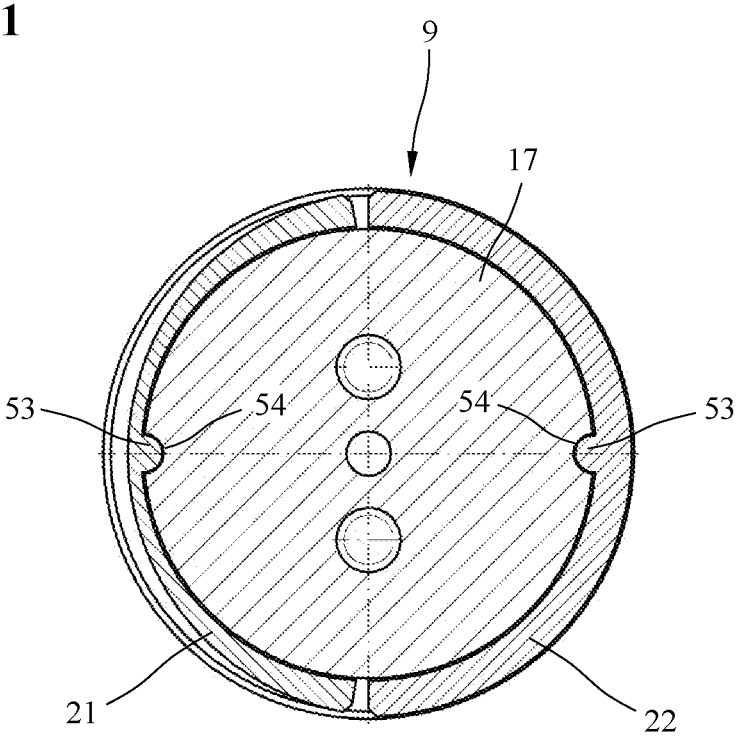
FIG. 11 is a cross-section along line C-C of FIG. 8.

Positioning elements 53 shown in in FIG. 11 are arranged on the insides of the bezel parts 21 and 22 beneath the hook-like shoulders 47 shown in FIG. 10, for shape-mated engagement with corresponding mating elements 54 on the outside of the base element 17. The positioning elements 53 in the illustrative embodiment shown are designed as inwardly protruding semicircular shoulders. The mating elements 54 are designed as semicircular recesses on the outside of the base element 17. A defined position of the bezel parts 21 and 22 secured against rotation can be specified via the positioning elements 53 and the corresponding mating elements 54.

The bezel parts 21 and 22, which serving to laterally delimit the breech face 18, can thus be replaced during a change in caliber with additional bezel parts adapted to the desired caliber. By exchanging the position of the two bezel parts 21 and 22, the cartridge ejection direction can also be easily changed. Complete bolt heads need not be provided for a change in caliber or a change in cartridge ejection direction. Instead, depending on the caliber and cartridge ejection direction, correspondingly adjusted bolt heads can be simply assembled and easily installed using a standardized base element. This can reduce the cost for a caliber change or adjustment of cartridge ejection direction can therefore be reduced.

The invention is not limited to the breech block and the locking device used therein, as described in detail above. The locking head according to the invention is also applicable to other breech blocks with other locking mechanisms. The bolt head, for example, can also be used in cylindrical breeches with a radial locking breech or breeches with other locking mechanisms.

LIST OF REFERENCE NUMBERS

1 Barrel
2 Locking sleeve
3 Bolt handle
4 Breech block
5 Receiver or breech housing
6 Bolt carrier
7 Outer guide rail
8 Inner holding element
9 Bolt head
10 Locking device
11 Trigger mechanism
12 Trigger latch
13 Widening
14 Recess
15 Locking element
16 Transverse axis
17 Base element
18 Breech face
19 Guide surface
20 Bezel
21 First bezel part
22 Second bezel part
23 Transverse hole
24 Flat
25 Journal
26 Pin
27 Front part of locking element
28 Rear part of locking element
29 Contact surface
30 Locking shoulder
31 Annular groove
32 Support surface
33 Front control surface
34 Rear control surface
35 Control element
36 Front support area
37 Rear support area
38 Push part
39 Pin
40 Rear end of control element
41 Firing pin
42 Through-opening
43 Blind hole
44 Holding groove
45 Inside surface
46 Inner contact surface
47 Hook-like shoulder
48 Circlip
49 Annular groove
50 End piece
51 Blind hole
52 Cartridge ejector
53 Positioning element
54 Mating element

The invention claimed is:

1. A bolt head of a breech block, the bolt head comprising a base element, a breech face arranged on a front of the base element, and a bezel enclosing the breech face in annular fashion, wherein the bezel is formed by a plurality of bezel parts detachably fastened to the base element, and wherein an inwardly curved guide surface is provided on a back of the base element for guiding pivotable locking elements.

2. The bolt head according to claim 1, wherein the plurality of bezel parts comprises two half-ring-shaped bezel parts detachably fastened to the base element to laterally delimit the breech face.

3. The bolt head according to claim 1, wherein a holding groove is spaced from the front of the base element, and wherein the holding groove runs around an outer periphery for shape-mated engagement of the plurality of bezel parts.

4. The bolt head according to claim 3, wherein the plurality of bezel parts have an inner contact surface at a rear for contact with the breech face and a hook-like shoulder for engagement in the holding groove.

5. The bolt head according to claim 1, wherein the plurality of bezel parts are held together by a circlip.

6. The bolt head according to claim 5, wherein the plurality of bezel parts contain an annular groove on an outside for accommodating the circlip.

7. The bolt head according to claim 5, wherein the circlip has an inwardly protruding perpendicular end piece at one end for engagement in a radial blind hole on an outside of one of the plurality of bezel parts.

8. The bolt head according claim 1, wherein positioning elements are arranged on an inside of the plurality of bezel parts for shape-mated engagement in corresponding mating elements on an outside of the base element.

9. The bolt head according to claim 1, wherein a claw-like cartridge ejector is formed integrally with the plurality of bezel parts.

10. A breech block with a bolt carrier, on which the bolt head according to claim 1 and a locking device are arranged to secure the bolt head in a locking position.

11. The breech block according to claim 10, wherein the locking device contains two diametrically opposed locking elements pivotable between the locking position and a release position by means of a control element.

12. The breech block according to claim 11, wherein the locking elements are mounted to pivot around a common transverse axis.

13. The breech block according to claim 11, wherein the locking elements have an outwardly curved contact surface on the front side thereof for contact with the bolt head.

* * * * *